United States Patent [19]

Rushforth

[11] Patent Number: 4,531,568

[45] Date of Patent: Jul. 30, 1985

[54] FLUID COOLED CASTING APPARATUS HAVING IMPROVED FLUID SEAL

[75] Inventor: Calvin Rushforth, Andover, Mass.

[73] Assignee: Kennecott Corporation, Cleveland, Ohio

[21] Appl. No.: 536,831

[22] Filed: Sep. 30, 1983

Related U.S. Application Data

[63] Continuation of Ser. No. 228,549, Jan. 26, 1981, abandoned.

[51] Int. Cl.[3] ..... B22D 11/124

[52] U.S. Cl. ..... 164/439; 164/443; 164/484

[58] Field of Search ..... 164/348, 443, 485, 418, 164/484, 297, 439

[56] References Cited

U.S. PATENT DOCUMENTS

| | | | |
|---|---|---|---|
| 1,695,514 | 12/1928 | Uhrig | 164/297 |
| 2,862,265 | 12/1958 | Vaughn et al. | 164/443 |
| 2,984,876 | 5/1961 | Garmy | 164/348 |
| 4,172,375 | 10/1979 | Rushforth et al. | 72/137 |
| 4,211,270 | 7/1980 | Shinopulos et al. | 164/83 |
| 4,218,907 | 8/1980 | Ruhl | 72/241 |
| 4,232,727 | 11/1980 | Bower et al. | 164/76 |
| 4,301,857 | 11/1981 | Rushforth | 164/416 |
| 4,307,770 | 12/1981 | Shinopulos et al. | 164/416 |
| 4,349,145 | 9/1982 | Shinopulos et al. | 228/208 |

FOREIGN PATENT DOCUMENTS

| | | | |
|---|---|---|---|
| 1031936 | 7/1958 | Fed. Rep. of Germany | 164/443 |

*Primary Examiner*—Kuang Y. Lin

*Attorney, Agent, or Firm*—R. Lawrence Sahr

[57] ABSTRACT

An apparatus for the continuous casting of metallic strand from a melt has a fluid-cooled coolerbody surrounding a casting die, and resilient O-ring seals which surround the upper and lower ends of the coolerbody to contain the cooling fluid within a distribution conduit. Extensions of the cooling fluid distribution conduit are formed within the coolerbody between the O-rings and the heat-dissipating strand, as protective thermal barriers to limit the temperature rise experienced by the O-rings. An annular shield also is disposed intermediate the upper O-ring and the strand to form two air gaps which enhance the thermal barrier effect.

8 Claims, 3 Drawing Figures

FLUID COOLED CASTING APPARATUS HAVING IMPROVED FLUID SEAL

This is a continuation of Ser. No. 228,549, dated Jan. 26, 1981, now abandoned.

BACKGROUND OF THE INVENTION

The present invention relates generally to a fluid cooled casting apparatus for the continuous casting of metallic strand and, more particularly, to such an apparatus having an improved cooling fluid seal which facilitates repair and maintenance.

It is well known in the prior art that it is possible to continuously cast a metallic strand from a molten mass of the metal by immersing the end of a refractory material die into the melt and then withdrawing the melt upwardly through the die and gradually cooling the melt into a solid strand. Generally, the cooling is accomplished by surrounding the die with a snuggly fitting coolerbody made of a material having good thermal conductivity characteristics, and circulating a cooling fluid, such as water, through the coolerbody to extract the heat of solidification therefrom. It is imperative that this cooling fluid be sealed completely within the coolerbody. Contact of the fluid with the strand within the die will contaminate the finished product; and, contact with the high-temperature melt may produce an explosion.

In U.S. Pat. No. 4,211,270, which has a common assignee as the present application, there is disclosed a coolerbody structure which employs a copper-gold braze to effect the fluid-containing seal. Not only is such a braze an increasingly more expensive procedure, but the more or less permanent nature of a braze interferes with maintenance or replacement of parts within the casting apparatus. The removal of the braze to allow separation of mating pieces of the coolerbody is a time-consuming procedure, and the heat and mechanical stresses thus induced often irretrievably damage elements of the coolerbody and prevents their reuse. Such waste means unnecessary expense.

The high temperatures experienced by the coolerbody during a typical casting operation have hindered the effectiveness of conventional O-ring seals. The prolonged exposure of the O-ring's constituent rubber material to these temperatures produces deterioration of the material and eventually destroys the effectiveness of the seal. Because of the potential safety hazard, such a seal has not heretofore been acceptable.

Therefore, it is an object of the present invention to provide a means for sealing and containing the cooling fluid within the interior of a coolerbody and to do so in a manner that facilitates disassembly of the coolerbody for repair.

It is a further object of the present invention to provide a sealing means whose removal during disassembly does not irreversibly damage adjacent components of the casting apparatus.

It is still a further object of the present invention to provide a simple, reliable sealing means which can withstand the typically high temperatures associated with metal casting procedures.

SUMMARY OF THE INVENTION

The present invention resides in an improvement to an apparatus for the continuous casting of a metallic strand from a metallic melt. The conventional apparatus has a die of refractory material in fluid communication with the melt through which die the metallic strand is drawn. A thermally conductive coolerbody surrounds at least a portion of the die to extract heat therefrom. The conventional casting apparatus also includes a conduit for passing a cooling fluid through the coolerbody. Specifically, the improvement of the present invention comprises O-ring seals mounted to the coolerbody for containing the cooling fluid within the conduit, and a thermal barrier within the coolerbody adjacent the O-ring seals for maintaining the temperature of the O-ring at a level insufficient to damage the O-rings.

In a specific embodiment of the invention, two O-ring seals are used: one surrounding the lower portion of the coolerbody and the other surrounding the upper portion. The thermal barrier associated with the lower O-ring consists of an extension of the cooling fluid-bearing conduit to a point at which it intersects the portion of the coolerbody between the O-ring and the die, so as to counteract the transmission of heat from the die to the O-ring. The thermal barrier associated with the upper O-ring also includes such an extension of the cooling fluid conduit to the region between the O-ring and the enclosed metallic strand. But, this upper barrier also utilizes a hollow cylindrical insert made of a material with a relatively poor thermal conductivity, which fits into a recess within the coolerbody and produces two heat-retarding air gaps, one between the outer surface of the insert and the coolerbody, and a second between the inner surface of the insert and the metallic strand.

At both the upper and lower O-ring positions, the thermal barriers limit the temperatures experienced by the O-rings so that they are not subjected to the temperatures which would melt the O-rings or otherwise deteriorate the seal.

This embodiment also features an annular ring which surrounds the lower portion of the coolerbody at the location of the lower O-ring and is bolted at several locations to the coolerbody. The inner surface of the annular ring compresses the lower O-ring and effects a seal. A threaded bayonet-type coupling receives the threaded upper portion of the coolerbody and is arranged such that a portion of the coupling compresses the upper O-ring to effect a seal. The cylindrical insert is press-fit to the coupling and extends into the interior of the coolerbody. To gain access to the interior of the coolerbody for maintenance, it is a simple matter to remove the mounting bolts holding the annular ring to the lower portion of the coolerbody, and then to unscrew the upper portion of the coolerbody from the coupling.

The structure as described herein is generally acceptable for production of a metallic strand having a diameter up to $2\frac{1}{2}$ inches. Depending on the mass of the particular strand being cast, certain operating parameters may vary such as, for example, the rate of flow of cooling fluid through the coolerbody, the length and total outer surface area of the coolerbody, and the thickness of the refractory material die.

The objects and features of the invention will be more fully understood from the following detailed description which should be read in light of the accompanying drawings.

DESCRIPTION OF THE PREFERRED EMBODIMENT

Figure 1:
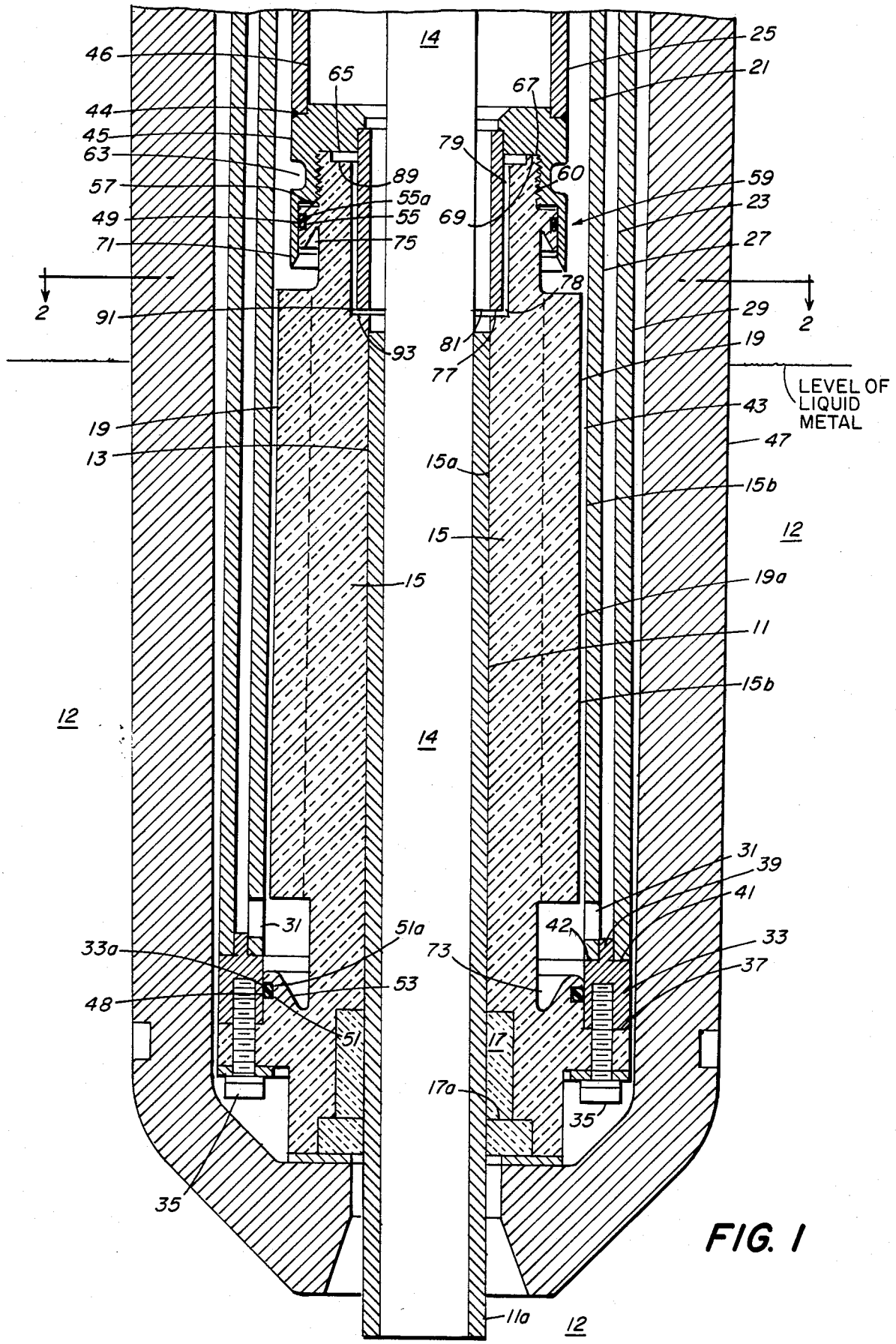
FIG. 1 is an elevation view, in section, of a casting apparatus incorporating the improved seal arrangement in accordance with the present invention.

Referring to FIG. 1, a hollow, generally tubular die 11, is oriented in a vertical direction with its lower end 11*a* protruding into a melt 12 of the particular metal being cast. The melt is drawn upwardly through the die in any conventionally known manner, and is cooled into a metallic strand 14. The upper portion of the die 11 is tightly contained within a cylindrical cavity 13 formed in the interior of a coolerbody 15. Typically, the die is made of a refractory material, such as graphite, which can withstand the thermal shock generated by the casting process, while the coolerbody is made of a metal having exceptionally good thermal conductivity characteristics, such as copper, or a copper alloy. The die 11 fits snuggly within the cavity 13 to provide maximum contact between the outer surface of the die and an inner surface 15*a* of the coolerbody, across which interface extraction of the heat of solidification from the strand 14, through the die 11, is accomplished. Insulating inserts or bushings 17, 17*a* surround the die 11 at the location where the die 11 enters into the coolerbody 15. These bushings 17 are formed of a refractory material having a relatively low coefficient of thermal expansion such as, for example, cast silica glass ($SiO_2$). They prevent expansion of the die at this location and maintain a uniform cross-section of the cast strand. Without these insulators the die would thermally expand, due to the extreme heat of the melt in which it is deposited, and would produce a strand having a diameter larger than the inner diameter of the rest of the die. Were this the case, this larger diameter strand could wedge within the narrower upper portion of the die causing blockage of the die and interruption of the casting process.

Figure 2:
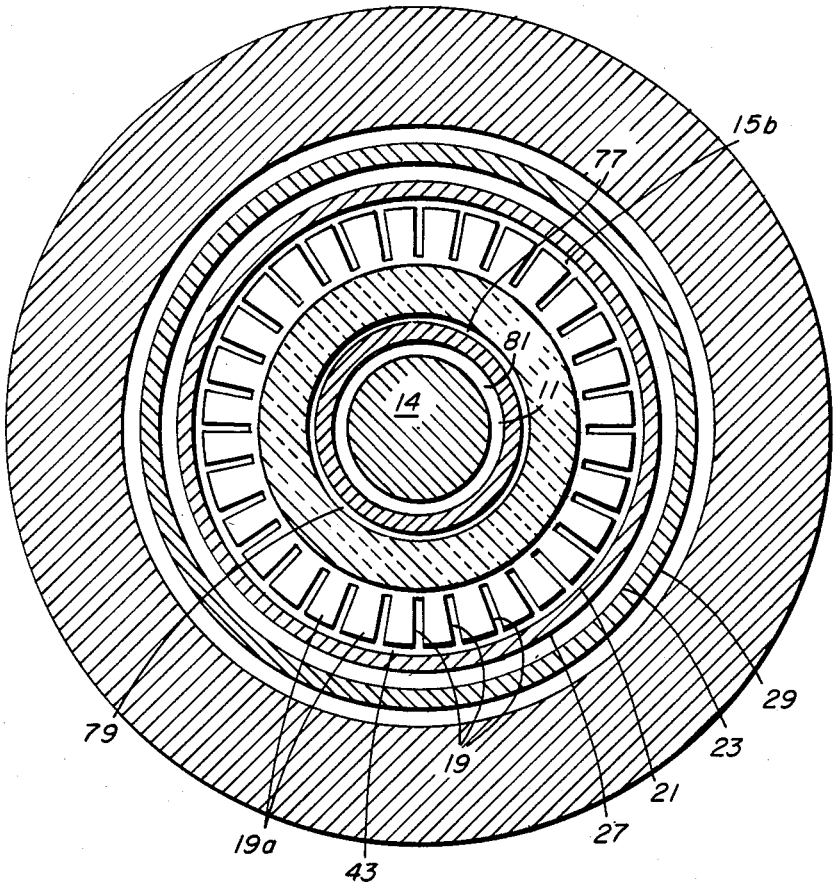
FIG. 2 is a cross-sectional view taken along lines 2—2 of FIG. 1, showing the finned outer surface of the coolerbody.

In order to dissipate the heat extracted by the coolerbody 15 from the die 11, it is necessary to direct a flow of cooling water or other acceptable cooling fluid across an outer surface 15*b* of the coolerbody 15. In the embodiment of FIG. 1, and as shown more in detail in FIG. 2, the outer surface 15*b* of the coolerbody consists of a series of thirty-two radially extending fins 19 of equal height, which are distributed at equal spacings around the outer periphery of the coolerbody. It is intended that alternate heat dissipating surface configurations be used as well such as, for example, the configuration disclosed in the coolerbody of the above-mentioned U.S. Pat. No. 4,211,270. There, instead of fins, the coolerbody has two concentrically arranged groups of parallel cylindrical holes which extend down into the coolerbody. However, the fin configuration of FIG. 1 is particularly suitable for the casting of larger diameter strands larger than $\frac{3}{4}$ inch for which a significantly longer coolerbody is required to properly cool the larger mass strand. The longer the coolerbody, the more difficulty it becomes to drill long, straight, parallel holes through the coolerbody because of the tendency of the longer drill bit to vibrate and wander or deviate from a straight line. In such a situation, the external fin configuration is preferable because it can more easily and quickly be machined on a milling apparatus and, therefore, is less costly to fabricate.

Two concentric annular passageways or conduits 21, 23, for transporting the cooling fluid which passes over the finned outer surface 15*b* of the coolerbody, are formed by a concentric arrangement of three coolant sleeves, an inner sleeve 25 (see FIG. 1), a middle sleeve 27, and an outer sleeve 29, which fit one within another. Each of these coolant sleeves is attached at its upper end to a manifold (not shown) which constitutes the source of the cooling fluid to be circulated through the passageways 21, 23. A fluid inlet (not shown) communicates with the inner passageway 21 while a fluid outlet (not shown) communicates with the outer passageway, so that the cooling fluid is pumped downwardly into the inner passageway 21, across the fins 19, thereby extracting heat therefrom, through a transverse passage 31, and upwardly through the outer passageway 23 to be discharged. The rate of flow of the cooling fluid varies, depending on such factors as the size of the strand being cast, the wall thickness of the die, or the length of the coolerbody. However, the design objective sought is that the cooling fluid temperature increase from inlet to outlet shall be in the range of 10° to 15° F. The rate of flow is adjusted to achieve this objective.

Referring again to FIG. 1, the outer coolant sleeve 29 extends downwardly from the cooling fluid manifold and encompasses almost the entire coolerbody 15. A positioning ring 33, secured by bolts 35 to a shoulder 37 machined in the coolerbody 15, anchors the bottom end of the outer coolant sleeve 29. The positioning ring 33 has an upwardly extending central lip portion 39 which creates two recesses 41, 42. The outer recess 41 accommodates the bottom end of the outer coolant sleeve 29; and, the inner recess 42 receives the bottom portion of the middle coolant sleeve 27. The outer coolant sleeve 29 is welded or joined in any other suitable fashion to the positioning ring 33 to increase the structural integrity and stability of the assembly. The middle coolant sleeve 27 is merely press-fit into the inner recess 42. A small clearance space 43 is provided between the outer edges 19*a* (see FIG. 2) of the fins 19 to maximize the surface area contacted by the cooling fluid. In other words, the cooling fluid contacts not only the radially extending walls of the fins, but also the outer circumferential edge surfaces 19*a* as well.

The bottom end of the inner coolant sleeve 25 is welded at 44 to a coupling ring 45, which mechanically engages the upper portion of the coolerbody in a manner described hereinafter in greater detail. The weld 44 provides a fluid-tight seal to prevent the passage of cooling fluid into the interior of the sleeve 25. Not only does the inner coolant sleeve 25 form part of the inner passageway 21, but its bore 46 serves to guide the movement of the cast strand after emergence of the strand from the snug-fitting confines of the die 11. Within this bore 46 heat continues to emanate from the strand, is transmitted by convection to the inner coolant sleeve 25, and is dissipated by the cooling fluid passing over the inner coolant sleeve outer surface.

An outer casing or protective cap 47 made of a suitable ceramic material surrounds the entire casting apparatus, at least to the level to which it is normally immersed in the melt. This cap serves to insulate the overall casting apparatus from the potentially damaging temperatures of the molten metal. Obviously, if the heat of the melt 12 were to be transferred directly to the outer cooling sleeve 29, the effectiveness of the liquid cooling system would be negated.

As discussed above, it is very important that the cooling fluid be contained to the two annular passageways 21, 23. Any contact of the fluid with the strand would have detrimental effects on its physical properties such as, for example, the surface smoothness of the strand. Even more importantly, if the cooling fluid were to escape from the casting apparatus into the high temperature molten metal, an explosion may result upon contact. To contain the cooling fluid within the described boundaries, a lower and an upper O-ring seal, 48, 49 respectively, made of a resilient compressible material, are provided. The lower O-ring 48 fits within a recess 51 provided in a projection 53 integrally formed within the lower portion of the coolerbody 15. It can be seen that this projection 53 also provides a shoulder which determines the lateral placement of the positioning ring 33. Thus, the lower O-ring 48 is compressed into a seal between an outwardly facing surface 51*a* of the recess 51 and an inwardly facing and oppositely directed surface 33*a* of the positioning ring 33. When properly formed, the seal will prevent passage of the cooling fluid below the level of the O-ring 48.

Figure 3:
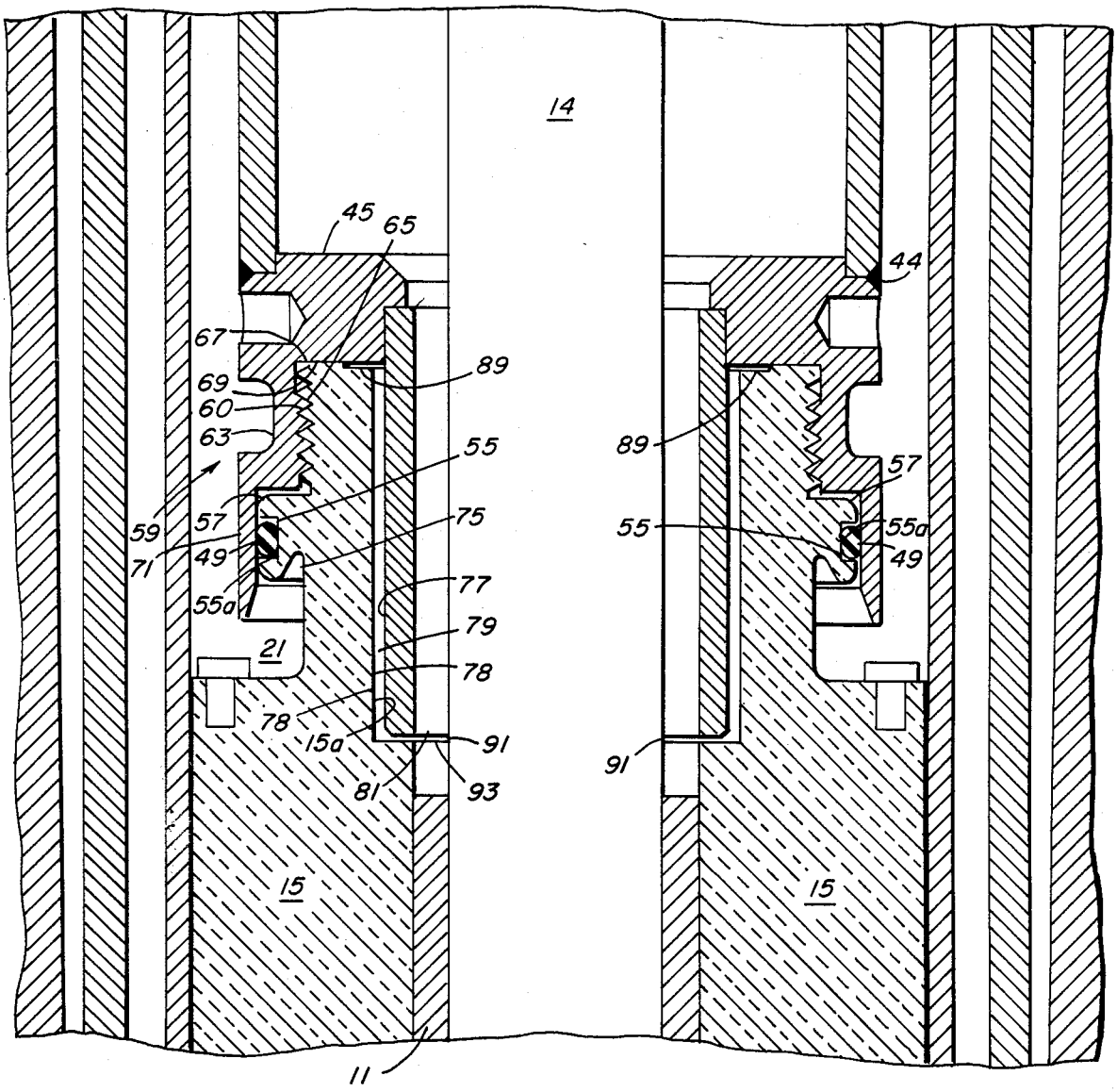
FIG. 3 is a detail view, showing the placement of the heat shield insert within the apparatus of FIG. 1.

Referring now to FIG. 3, the upper O-ring 49 similarly is seated within a circular recess 55 formed within an outward lobe 57 extending from an upwardly directed neck portion 59 of the coolerbody 15. The neck portion is threaded directly above this lobe at 60. The coupling ring 45 has a receptacle portion 63 with a mating thread 65 which receives the threaded neck portion 60 of the coolerbody. The neck portion 59 is threadably engaged within the coupling ring 45 and is advanced to the fully seated position, as determined by the engagement of a top edge 67 of the neck with an inner surface 69 of the coupling ring. In this position, the O-ring is compressed between an outwardly facing surface 55*a* of the circular recess 55 and an inwardly facing surface of a vertical flange 71 integrally formed with the coupling ring 45.

A particularly suitable material used for the sealing O-rings 48, 49 is Viton (a trade name of E. I. duPont de Nemours and Company, Inc. for synthetic rubber). In order for this material to maintain proper resiliency and other sealing qualities, the temperature to which it is exposed must not exceed 350° F. Unless compensated for, the extremely good thermal conductivity characteristics of the coolerbody may cause the temperatures at the O-rings to exceed the 350° F. danger point during casting. A thermal barrier, in the form of a circular channel 73 cut into the coolerbody 15, is provided to protect the lower O-ring 48. The channel 73, which forms an extension of the inner passageway 21, is intermediate the O-ring 48 and the die 11 from which the heat of solidification is being extracted. Not only does the channel 73 interrupt the direct metallic path between the die and the O-ring 48 but, by extending so close to the recess 51, it also provides for localized cooling of the coolerbody immediately adjacent the O-ring 48. Thus, the channel has a dual effect on the temperature experienced by the O-ring 48. The cooling water, after passing through the fins 19, circulates within the channel 73 before continuing through the transverse passage 31 into the outer annular passage 23, and then finally out through the outlet (not shown).

In the case of the upper O-ring 49, because of a smaller diameter and a closer proximity to the strand being cast, dual thermal barriers are provided. As in the case of the lower O-ring seal, an extension 75 of the inner annular passageway 21 is provided to allow the cooling fluid to intersect the coolerbody 15 in the region between the upper O-ring 49 and the closest point on the inner surface 15*a*. An additional thermal barrier member is provided in the form of a hollow cylindrical heat shield insert 77 inboard of the O-ring 49. A recess 78 within the upper portion of the coolerbody, at a height above the end of the die 11, accommodates the downwardly protruding insert 77. The outer diameter of the insert 77 is smaller than the inner diameter of the recess 78, so that an air gap 79 separates the outer surface of the insert 77 from the coolerbody 15. The heat shield insert 77 has an inner diameter which is larger than the diameter of the strand so that there is provided a second air gap 81 separating the strand from the insert.

The air gaps form discontinuities in the highly thermally conductive path provided by the coolerbody between the casting and the O-ring 49, and thus retards the heat flow. However, an even more significant amount of resistance to the heat flow is provided by the presence of stagnant films of air which form on each of the surfaces defining the air gaps. Absent the shield insert 77, there would be only one such air gap, namely between the outer surface of the strand and the inner surface of the coolerbody, and therefore only two such air films on the respective surfaces. However, with the second air gap, two additional intervening surface films are created, namely on the inner and outer surfaces of the shield insert 77. Doubling the number of surface films effectively cuts in half the heat flux passing between the strand and the coolerbody.

A typical material, out of which the insert may be fabricated, is #304 stainless steel, having a heat conductivity of about 0.036 cal-cm/cm$^2$/°C./sec, considerably lower than the heat conductivity of a copper coolerbody, which is about 0.94 cal-cm/cm$^2$/°C./sec. The upper end of the heat shield insert 77 is press-fit within a mating recess in the coupling ring 45, so that when the coolerbody is unscrewed from the coupling ring 45, the insert 77 remains within the coupling ring. Therefore, the total thermal protection provided to the upper O-ring 49 is the combination of the inner air gap 81, the low-conductivity heat shield insert 77, the outer air gap 79, the four stagnant surface air films and the cooling fluid passageway extension 75.

Not only are the upper and lower O-ring seals cheaper and easier to fabricate than the previously used brazed seals, but they also facilitate disassembly of the casting apparatus for maintenance. For example, if access is desired to the inner portion of the coolerbody, it is a simple matter, after removing the outer ceramic protective cap 47 (see FIG. 1), to unbolt the series of bolts 35 extending around the periphery of the lower portion of the coolerbody, to detach the coolerbody from the positioning ring 33, to unscrew the coolerbody from the coupling ring 45 and remove it as an integral unit from the interior of the coolant sleeve 27. Because there is no permanent-type joint, such as a braze, to be removed from the interface between the coolerbody 15 and the positioning ring 33, there is minimal possibility of damage to these components to preclude their reuse upon reassembly of the apparatus. For example, a deformation of the closely matched contours of the positioning ring 33 and the mating projection 53 of the coolerbody might preclude proper repositioning of these two units relative to each other. However, such a situation is avoided by the easily removable O-ring seal structure. At the very most, replacements of the O-rings themselves would be required upon reassembly of the casting apparatus, a more or less standard procedure when using O-rings.

It is possible to enhance further the seal provided between the upper portion of the coolerbody and the inner annular passageway 21 by providing a 16 micro-inch surface finish to both the downwardly facing inner surface 69 of the coupling ring 45 and the abutting upwardly-facing edge 67 of the threaded portion 60 of the coolerbody 15. When the coolerbody is threaded fully within the coupling ring and seated in its final position, not only is the O-ring 49 compressed within its recess to form a seal, but the abutting 16 micro-inch surfaces similarly provide a sealing action. A small cut-out 89 can be provided to reduce the total contact area between these two surfaces and thereby to increase the pressure therebetween and enhance the seal.

A space 91 shown between the bottom of the heat shield insert 77 and a lower lip 93 of the recess 78 is of such a magnitude that the thermal expansion experienced by the shield insert 77 during operation of the casting apparatus will close up this gap and provide a barrier against contaminating vapors such as, for example, the zinc vapors which are by-products of the brass-casting process. Containment of the gaseous vapors minimizes the possibility of their condensation within the casting apparatus and facilitates their evacuation therefrom.

While the invention has been described with reference to its preferred embodiment, it will be understood that modifications and variations will occur to those skilled in the art. For example, the shape or configuration of the extensions of the cooling fluid passages may vary depending on the application and the spacings between the heat shield insert and the coolerbody may vary depending on heat transfer characteristics. Similarly, the shape of the heat shield insert may be varied to adapt to particular situations. Such modifications and variations are intended to fall within the scope of the appended claims.

What is claimed and desired to be secured by letters patent is:

1. In an improved apparatus for the continuous casting of a metallic strand from a melt in which said apparatus is partly immersed, having a die of a refractory material in fluid communication with said melt, the die substantially defining a mold cavity through which mold cavity said strand is drawn, a thermally conductive coolerbody, surrounding at least a portion of said die to extract heat therefrom, and conduit means for passing a cooling fluid through said coolerbody, said coolerbody having a first end portion positioned below a second end portion, with only said first end portion encompassing said die, the improvement comprising:

O-ring sealing means mounted in a recess of said coolerbody for containing said cooling fluid within said conduit means, said O-ring sealing means comprising:

a resilient first O-ring surrounding said first end portion of said coolerbody;

an annular positioning member secured to said coolerbody and surrounding said first O-ring in compressive engagement therewith;

a resilient second O-ring surrounding said second end portion of said coolerbody; and a coupling member which receives said second end portion of said coolerbody and surrounds said second O-ring, in compressive engagement therewith;

thermal barrier means within said coolerbody and between said mold cavity and said O-ring sealing means for maintaining the temperature of said O-ring sealing means at a level insufficient to damage said O-ring sealing means.

2. The improved apparatus as set forth in claim 1 wherein said thermal barrier means comprises:

means for circulating said cooling fluid in regions of said coolerbody between said O-rings and said die.

3. The improved apparatus as set forth in claim 2 wherein said means for circulating forms an extension of said conduit means.

4. The improved apparatus according to claim 3 wherein said thermal barrier means further comprises:

means for providing air gaps, in addition to air gaps between the die and the strand created as a result of shrinkage of the strand, within said coolerbody in the region between said second O-ring and said mold cavity.

5. The improved apparatus according to claim 4 wherein said air gap providing means comprises:

an annular shield fixed to said coupling member and protruding within a recess in said second end portion of said coolerbody so as to enclose said mold cavity, said annular shield having an outer diameter smaller than the dimensions of said recess and an inner diameter greater than the diameter of the enclosed mold cavity, thereby producing a first air gap between said mold cavity and said annular shield, and a second air gap between said coolerbody and said annular shield.

6. The improved apparatus according to claim 5 wherein said annular shield has a thermal conductivity less than that of said coolerbody.

7. The improved apparatus according to claim 6 wherein said recess has a shoulder portion opposing the lower end of said annular shield and spaced sufficiently closely thereto, whereby a vapor seal is formed by said lower end of said shield pressing against said shoulder upon thermal expansion of said shield during operation of the apparatus.

8. In an improved apparatus for the continuous casting of a metallic strand from a melt, having a die of a refractory material in fluid communication with said melt, said die substantially defining a mold cavity through which mold cavity said strand is drawn, a thermally conductive coolerbody having a first end portion positioned below a second end portion when said apparatus is immersed in said melt, with only said first end portion encompassing said die, and a conduit formed within said coolerbody for accommodating the flow of a cooling fluid therethrough, the improvement comprising:

a resilient first O-ring surrounding said first end portion of said coolerbody adjacent said conduit;

an annular positioning member secured to said coolerbody and surrounding said first O-ring, in compressive engagement therewith, thereby forming a first seal for containing said cooling fluid within said conduit; a first channel formed within said coolerbody intermediate said first O-ring and said die, said first channel intersecting said conduit whereby cooling fluid can circulate within said first channel;

a resilient second O-ring surrounding said second end portion of said coolerbody, adjacent said conduit;

a coupling member receiving said second end portion of said coolerbody and surrounding said second O-ring in compressive engagement therewith, thereby forming a second seal for containing said cooling fluid within said conduit;

a second channel formed within said coolerbody intermediate said second O-ring and said mold cavity, said second channel intersecting said conduit whereby cooling fluid can circulate within said second channel; and an annular shield fixed to said coupling member and protruding within a recess in said second end portion of said coolerbody so as to enclose said mold cavity, said annular shield having an outer diameter smaller than the dimensions of said recess and an inner diameter greater than the diameter of said mold cavity, thereby producing a first air gap between said mold cavity and said annular shield, and a second air gap between said coolerbody and said annular shield, whereby the temperatures of said O-rings are maintained at a level insufficient to damage said O-rings.

* * * * *